US008485648B2

(12) United States Patent
Sato

(10) Patent No.: US 8,485,648 B2
(45) Date of Patent: Jul. 16, 2013

(54) INKJET RECORDING APPARATUS

(75) Inventor: Daisuke Sato, Kamiina-gun (JP)

(73) Assignee: Riso Kagaku Corporation, Tokyo (JP)

( * ) Notice: Subject to any disclaimer, the term of this patent is extended or adjusted under 35 U.S.C. 154(b) by 774 days.

(21) Appl. No.: 12/565,031

(22) Filed: Sep. 23, 2009

(65) Prior Publication Data

US 2010/0073444 A1 Mar. 25, 2010

(30) Foreign Application Priority Data

Sep. 25, 2008 (JP) ..... 2008-246071

(51) Int. Cl.

| | |
|---|---|
| ***B41J 2/175*** | (2006.01) |
| ***B41J 29/38*** | (2006.01) |
| ***B41J 2/195*** | (2006.01) |
| ***B41J 2/17*** | (2006.01) |
| ***B41J 2/18*** | (2006.01) |

(52) U.S. Cl.
USPC ..... 347/85; 347/6; 347/7; 347/84; 347/89

(58) Field of Classification Search
USPC ..... 347/6, 7, 85, 84, 89
See application file for complete search history.

(56) References Cited

U.S. PATENT DOCUMENTS

| | | | | |
|---|---|---|---|---|
| 5,481,284 | A * | 1/1996 | Kitahara et al. | 347/42 |
| 7,128,404 | B2 * | 10/2006 | Kodama | 347/89 |
| 7,845,784 | B2 | 12/2010 | Nitta et al. | |
| 8,109,613 | B2 | 2/2012 | Nitta et al. | |
| 2007/0115329 | A1 * | 5/2007 | Takatsuka | 347/57 |
| 2007/0291086 | A1 * | 12/2007 | Murakami et al. | 347/85 |
| 2008/0273064 | A1 * | 11/2008 | Ota et al. | 347/85 |
| 2009/0122093 | A1 * | 5/2009 | Mutoh | 347/7 |

FOREIGN PATENT DOCUMENTS

| | | | |
|---|---|---|---|
| JP | 2001-219580 | A | 8/2001 |
| JP | 2003-182105 | A | 7/2003 |
| JP | 2008-962 | A | 1/2008 |
| JP | 2008-162262 | A | 7/2008 |

OTHER PUBLICATIONS

Japanese Office Action dated Dec. 11, 2012 (and English translation thereof) in counterpart Japanese Application No. 2008-246071.

* cited by examiner

*Primary Examiner* — Jannelle M Lebron
(74) *Attorney, Agent, or Firm* — Holtz, Holtz, Goodman & Chick, PC

(57) ABSTRACT

An inkjet recording apparatus is provided with an ink head having a nozzle face on which a nozzle for discharging ink is formed, a first tank stored with the ink to be supplied to the ink head through a first ink passage, a second tank stored with the ink not having been discharged from the ink head through a second ink passage, and a third ink passage connecting the second and first tanks. The inkjet recording apparatus is further provided with a pump disposed in the third ink passage and configured to feed the ink from the second tank into the first tank, a fourth ink passage connected in parallel with the pump, and a pressure regulation valve incorporated in the fourth ink passage.

3 Claims, 6 Drawing Sheets

INKJET RECORDING APPARATUS

CROSS-REFERENCE TO RELATED APPLICATIONS

This application is based upon and claims the benefit of priority from prior Japanese Patent Application No. 2008-246071, filed Sep. 25, 2008, the entire contents of which are incorporated herein by reference.

BACKGROUND OF THE INVENTION

1. Field of the Invention

The present invention relates to an inkjet recording apparatus having an ink supply passage capable of stabilizing a meniscus in an ink head.

2. Description of the Related Art

Generally, in an inkjet recording apparatus (inkjet printer), ink is discharged onto a recording medium, such as recording paper, to be recorded by means of a thermal or piezoelectric ink head.

An inkjet printer is disclosed in Jpn. Pat. Appln. KOKAI Publication No. 2001-219580, which uses the circulatory system as an ink supply system to keep the inside of an ink head at a predetermined negative pressure.

This inkjet printer includes the ink head that discharges ink, first and second ink chambers located above and below, respectively, of the ink head in the gravitational direction, a solenoid valve and a pump for controlling ink flow, and pipes connecting these elements. In this arrangement, the inside of the ink head is kept at the predetermined negative pressure by a difference in level (hydraulic head difference) between the first and second ink chambers.

Specifically, according to Jpn. Pat. Appln. KOKAI Publication No. 2001-219580, the first and second ink chambers are each provided with an ink level detector (liquid level sensor). The drive of the pump is controlled to keep the amount of ink in the first ink chamber constant, based on a detection value from the liquid level sensor in the first ink chamber. Further, ink is supplied from an ink tank for replenishment to keep the amount of ink in the second ink chamber constant, based on a detection value from the liquid level sensor in the second ink chamber. The pump used is a highly responsive one, whereby the rate of ink feed from the second ink chamber to the first ink chamber is varied depending on the amount of ink in the first ink chamber. Thus, the difference in level between the first and second ink chambers is kept constant to stabilize the meniscus.

BRIEF SUMMARY OF THE INVENTION

According to an embodiment of the present invention, there is provided an inkjet recording apparatus comprising: an ink head having a nozzle face on which a plurality of nozzles for discharging ink are formed; a first tank configured to store the ink to be supplied to the ink head; a first passage that connects the ink head and the first tank to each other; a second tank configured to store the ink not having been discharged from the ink head; a second passage that connects the ink head and the second tank to each other; a third passage that connects the second tank and the first tank to each other; a pump disposed in the third passage and configured to feed the ink from the second tank into the first tank; a fourth passage that connects a portion of the third passage upstream of the pump and a portion of the third passage downstream of the pump to each other; and a pressure regulation valve provided in the fourth passage.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will now be described in detail with reference to the accompanying drawings.

First Embodiment

Figure 1:
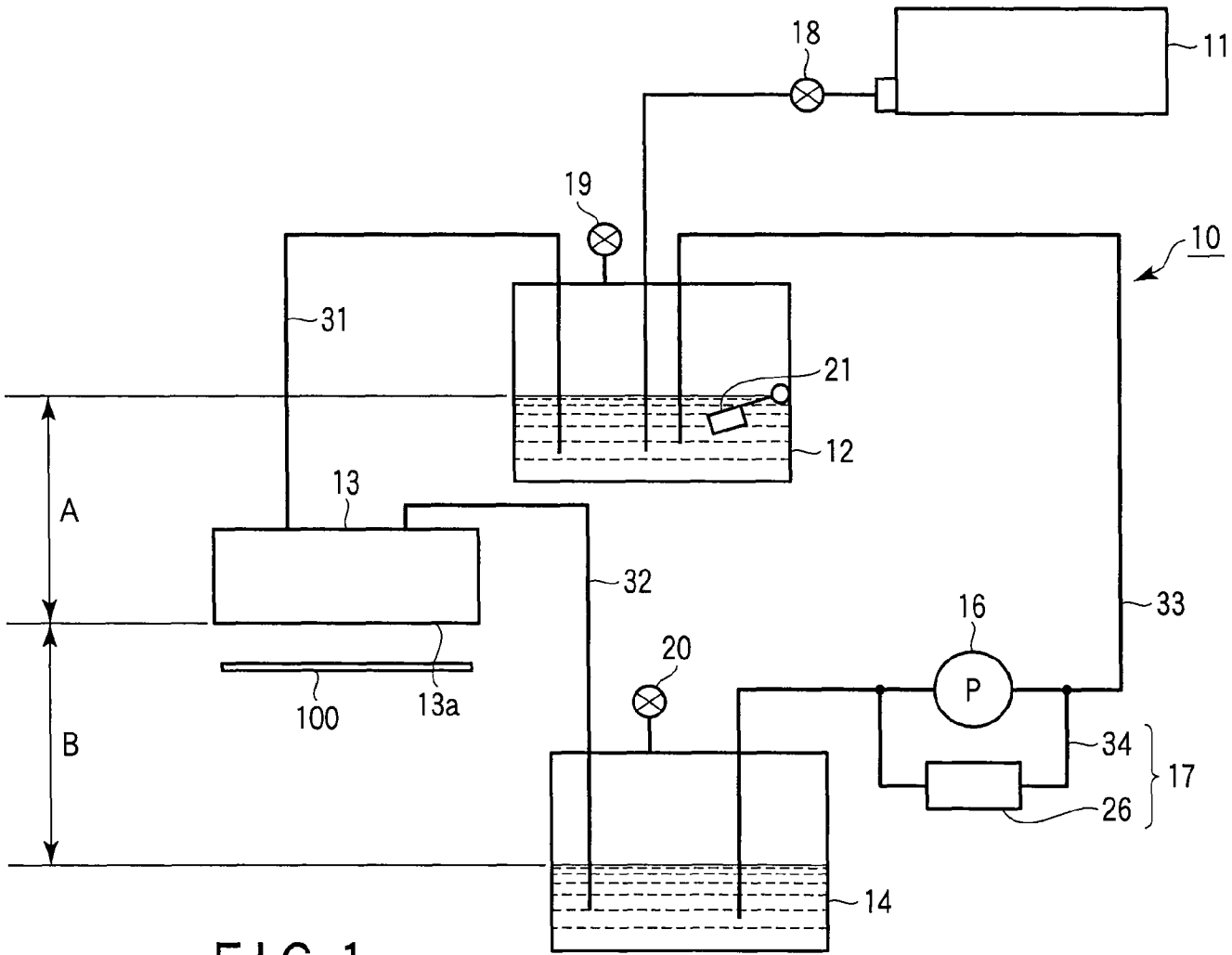
FIG. 1 is a block diagram showing a configuration of an inkjet recording apparatus according to a first embodiment of the invention.

FIG. 1 is a block diagram showing a configuration of an inkjet recording apparatus according to a first embodiment of the invention.

In FIG. 1, an inkjet recording apparatus 10 comprises an ink cartridge 11, first tank 12, ink head 13, second tank 14, pump 16, pressure regulation mechanism 17, supply valve 18, and atmospheric valves (first atmospheric valve) 19, and atmospheric valves (second atmospheric valve) 20.

In the inkjet recording apparatus 10, the first tank 12 and ink head 13 are connected by a first ink passage (ink supply passage) 31; the ink head 13 and second tank 14, by a second ink passage (ink discharge passage) 32; and the second and first tanks 14 and 12, by a third ink passage (ink return passage) 33.

Based on this arrangement, an ink circulation passage is formed such that ink circulates through the first tank 12, first ink passage 31, ink head 13, second ink passage 32, second tank 14, third ink passage 33, first tank 12, etc., in the order named.

Although not shown in FIG. 1, the inkjet recording apparatus 10 includes supply means for supplying a recording medium 100, conveying means for conveying the medium 100 supplied from the supply means, and discharge means for discharging the medium 100 on which an image is formed from the conveying means. The recording apparatus 10 further includes maintenance means for cleaning the ink head and control means for controlling the entire inkjet recording apparatus 10.

The ink cartridge 11 contains replenishment ink and is connected through the supply valve 18 to the first tank 12 by an ink tube. The supply valve 18 serves to control the ink supply from the ink cartridge 11 to the first tank 12. As described later, the valve 18 is opened when the amount of ink remaining in the first tank 12 falls below a predetermined value.

The first tank 12 is provided with atmospheric valve 19 and a float 21. Atmospheric valve 19 is atmosphere release means for switching the interior of the first tank 12 between a sealed state and atmospheric state. The float 21 is a detecting means for detecting the amount of ink in the first tank 12 and detects the liquid level in order to maintain the predetermined ink amount in the tank. If the amount of remaining ink is found to be smaller than the predetermined value by the detection, the supply valve 18 is opened, whereupon the ink is supplied from the ink cartridge 11 to the first tank 12. If the ink amount is judged to have reached the predetermined value, thereafter, the supply valve 18 is closed, whereupon the ink supply to the first tank 12 is stopped.

The first tank 12 is connected to the ink head 13 by the first ink passage 31 for supplying the ink. The first tank 12 is located above a nozzle face 13*a* of the ink head 13 with respect to the gravitational direction. More specifically, the first tank 12 is located so that the ink level in the tank 12 is above the nozzle face 13*a* of the ink head 13 in the gravitational direction. Thus, the ink in the first tank 12 flows through the first ink passage 31 into the ink head 13 by natural fall caused by a difference in level (hydraulic head difference) between the tank 12 and head 13.

In response to a signal from the outside (control section), the ink head 13 discharges the ink toward the recording medium 100 opposed thereto. The conveying means conveys the recording medium 100 in a predetermined direction in synchronism with the discharge of the ink.

The second tank 14 is connected to the ink head 13 by the second ink passage 32. The second tank 14 is provided with atmospheric valve 20. Atmospheric valve 20 constitutes atmosphere release means for switching the interior of the second tank 14 between a sealed state and atmospheric state.

The second tank 14 is located below the nozzle face 13*a* of the ink head 13 with respect to the gravitational direction. More specifically, the second tank 14 is located so that the ink level in the tank 14 is below the nozzle face 13*a* of the ink head 13 in the gravitational direction.

The ink not having been discharged from the ink head 13 flows out through the second ink passage 32 into the second tank 14 by natural fall caused by a difference in level (hydraulic head difference) between the head 13 and tank 14.

The pump 16 is disposed in the middle of the third ink passage 33 that connects the first and second tanks 12 and 14. In the present embodiment, a gear pump, for example, is used for the pump 16.

The drive capacity of the pump 16 is set so that more ink than the ink that flows into the second tank 14 can be fed into the first tank 12. This is done in order to prevent meniscus rupture in the ink head 13. Thus, in a normal operating state, the pressure in the second tank 14 can always be kept negative with respect to atmospheric pressure by making the flow rate of the ink that can be drawn out by the pump 16 higher than that of the ink that flows into the second tank 14.

The pressure regulation mechanism 17 is incorporated in the third ink passage 33.

The pressure regulation mechanism 17 will now be described in detail with reference to FIG. 2.

Figure 2:
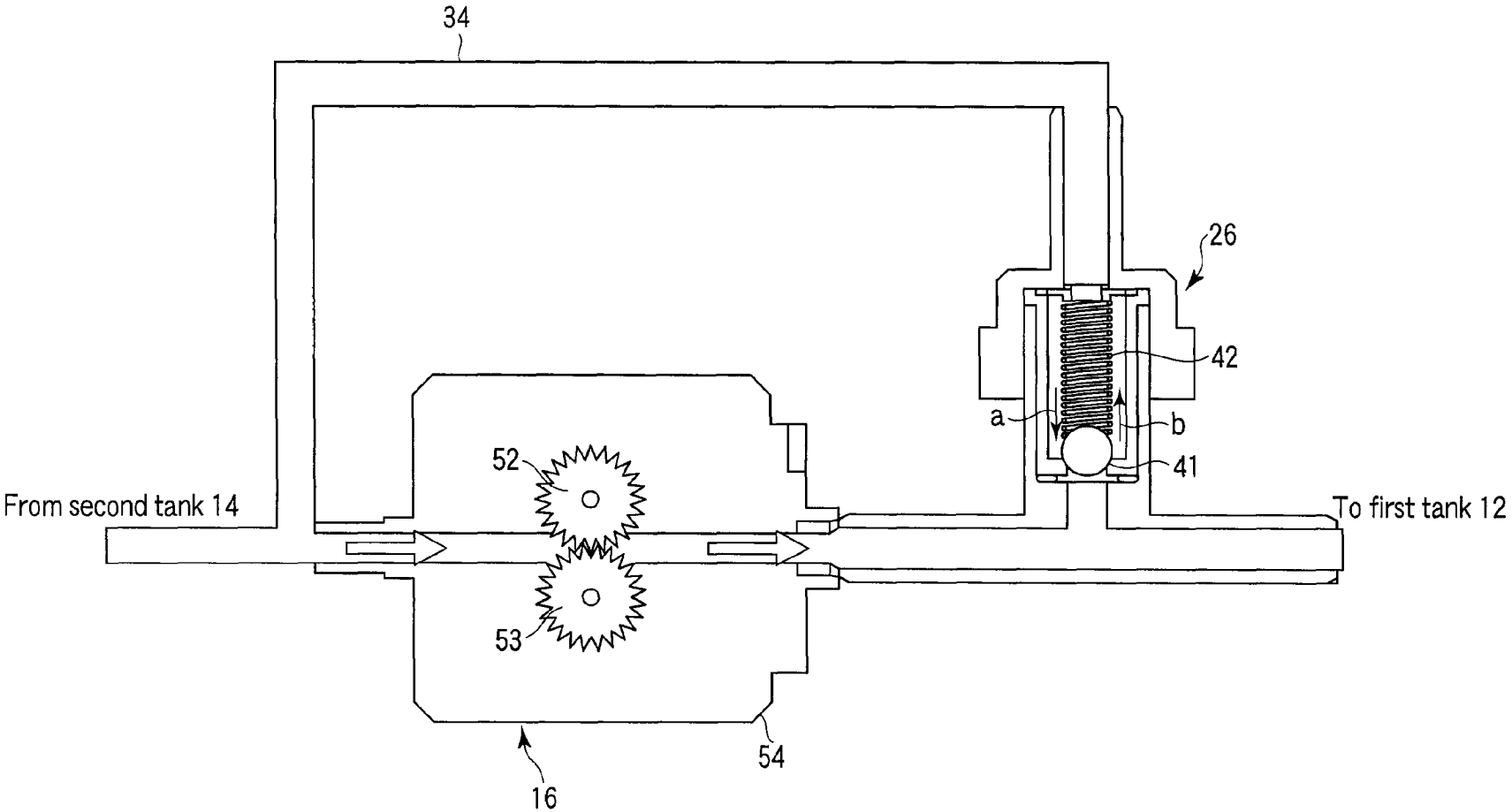
FIG. 2 is a view showing detailed configurations of the a pump, pressure regulation mechanism, and their surroundings shown in FIG. 1.

FIG. 2 is a view showing detailed configurations of the pump 16, pressure regulation mechanism 17, and their surroundings shown in FIG. 1.

A fourth ink passage 34 is provided for bypass connection between the upstream (second tank 14 side) and downstream (first tank 12 side) of the pump 16. The fourth ink passage 34 connects an inlet neighborhood of the pump 16 and an outlet neighborhood of the pump 16. The passage 34 is provided with a pressure regulation valve 26 comprising a valve element 41 and spring 42 for use as an urging member. The valve 26 blocks up the passage 34. Specifically, the communication between the upstream (second tank 14 side) and downstream (first tank 12 side) of the fourth ink passage 34 is cut off as the valve element 41 is urged in the direction of arrow a by the spring 42.

The pump 16 is formed of a drive gear 52 for rotation in a predetermined direction, driven gear 53 rotatable in mesh with a gear part of the drive gear 52, and casing 54. The pump 16 causes the drive gear 52 to rotate at a constant speed.

Now let us suppose that a force produced by the pressure difference between the upstream and downstream of the fourth ink passage 34 is greater than the force of the spring 42 that urges the valve element 41 in the direction of arrow a. In this state, the valve element 41 moves in the direction of arrow b. Thereupon, the upstream and downstream of the fourth ink passage 34 communicate with each other.

In the present embodiment, moreover, a filter (not shown) for removing foreign matter from the ink is incorporated in the ink circulation passage.

The following is a description of an ink circulation operation.

In the inkjet recording apparatus 10 of the present embodiment, the atmospheric valves 19 and 20 of the first and second tanks 12 and 14 are opened and closed, respectively, as the ink is circulated. In other words, the first tank 12 is open to the atmosphere, while the second tank 14 is sealed. The pump 16 is powered in this state. Thereupon, the ink flows from the first tank 12 to the second tank 14 via the ink head 13 by natural fall caused by the difference in level. Then, the ink in the second tank 14 is drawn into the first tank 12 by the pump 16. Thus, the ink repeatedly circulates in a loop starting and ending at the first tank 12 and extending through the ink head 13, second tank 14, and pump 16.

The following is a description of the nozzle pressure of the ink head 13 during the ink circulation.

Normally, the nozzle pressure of the ink head 13 is adjusted to a predetermined negative pressure based on a distance A (FIG. 1) from the nozzle face 13*a* of the head 13 to the surface of the ink in the first tank 12 and a distance B (FIG. 1) from the nozzle face 13*a* to the surface of the ink in the second tank 14. Thus, the first tank 12 applies a certain positive pressure to the ink head 13, while the second tank 14 applies a certain negative pressure to the ink head 13.

By controlling these two pressures (positive and negative pressures), a spherically concave ink meniscus is formed in the ink head 13 so that a normal printing operation can be performed. The ink head 13 of the present embodiment can normally discharge the ink as long as the pressure on the ink head 13 is within the range of −2.5 to −1.0 kPa.

The pump 16 is set so as be able to feed the first tank 12 with more ink than the ink that flows into the second tank 14. If the ink is discharged from the ink head 13 to be used for recording, moreover, the amount of ink that flows into the second tank 14 is reduced. Therefore, the ink level in the second tank 14 drops, so that the distance B between the nozzle face of the ink head 13 and the ink surface in the tank 14 increases.

Likewise, the ink level in the first tank 12 rises, so that the distance A between the nozzle face of the ink head 13 and the ink surface in the tank 12 increases. Specifically, the air volume in the sealed second tank 14 increases, so that the pressure in the tank 14 is reduced (or a negative force is enhanced). Accordingly, the balance of the nozzle pressure on the ink head 13 is broken, so that a desired meniscus cannot be formed, and printing is disabled.

According to the present embodiment, however, the pressure regulation mechanism 17 can prevent the aforementioned disabling of printing.

The operation of the pressure regulation mechanism 17 will now be described with reference to FIGS. 3 and 4.

Figure 3:
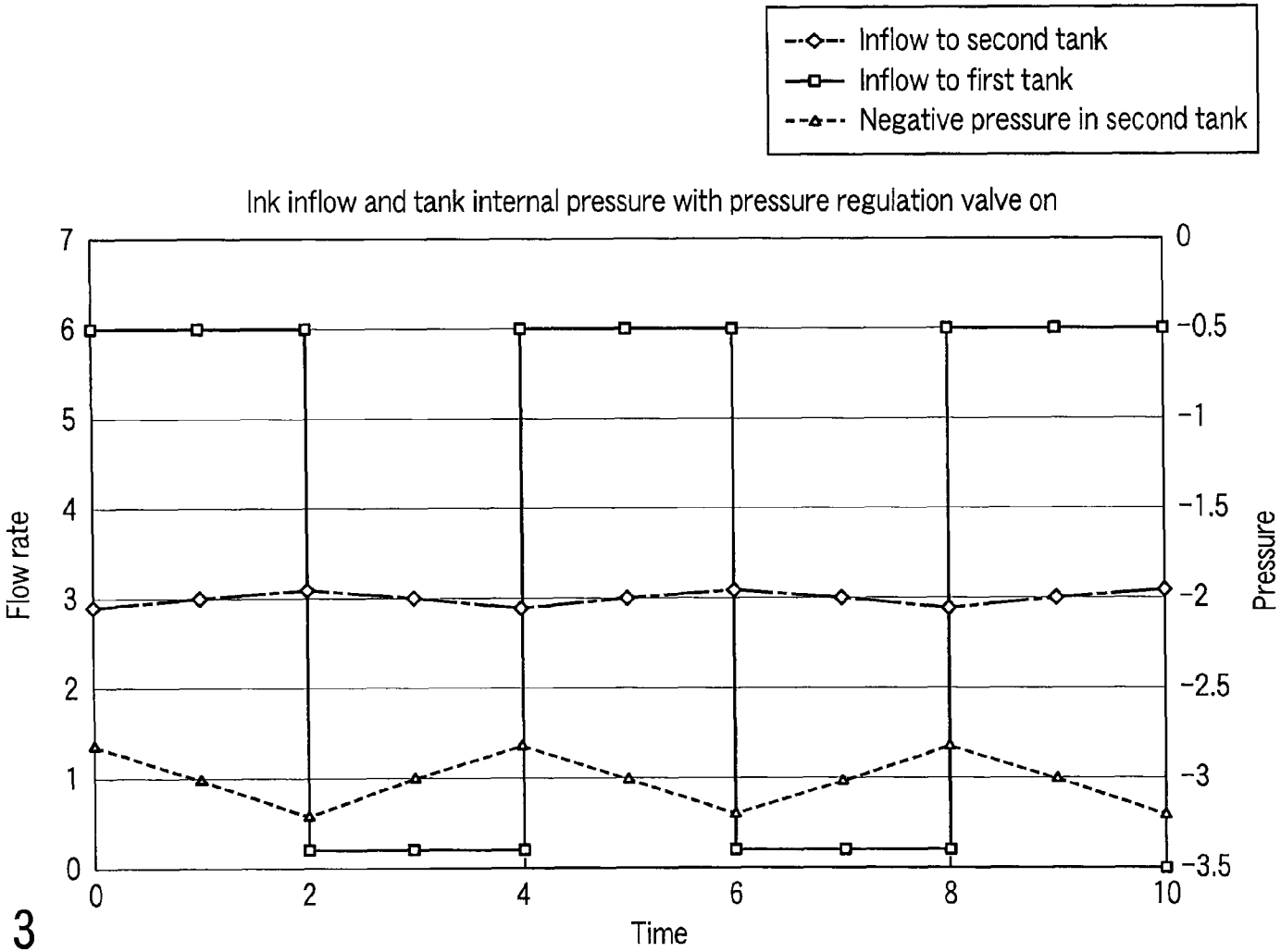
FIG. 3 is a diagram showing relationships between the rate of inflow from an ink head to a second tank, rate of inflow from the pump to a first tank, and negative pressure in the second tank when a pressure regulation valve is powered.
Figure 4:
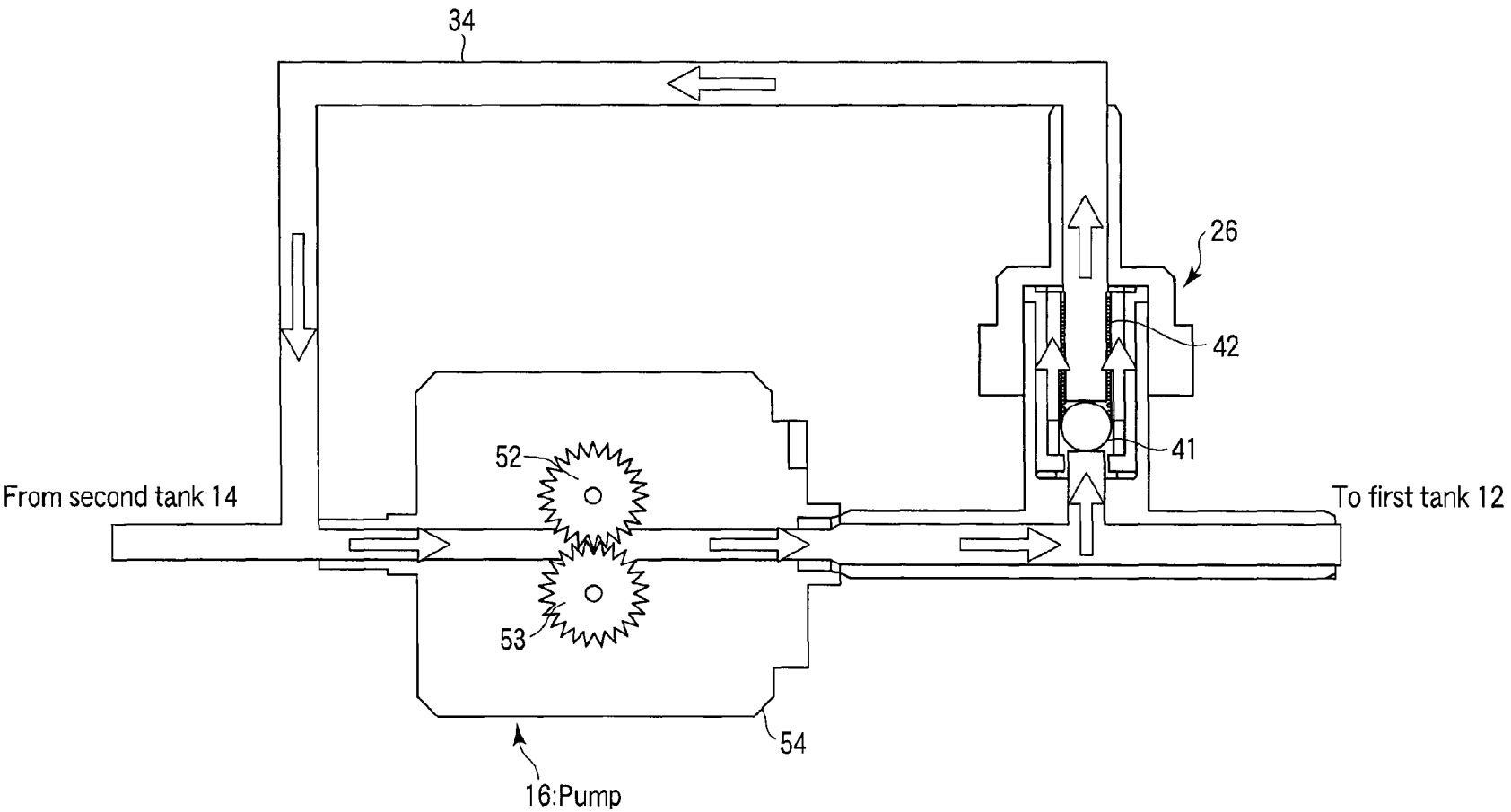
FIG. 4 is a view for illustrating ink flow in the pressure regulation mechanism when a fourth ink passage is open.

FIG. 3 is a diagram showing relationships between the inflow of the ink that flows into the second tank 14, inflow of the ink that flows into the first tank 12, and negative pressure in the second tank 14, during the operation of the pressure regulation valve 26. In FIG. 3, the abscissa represents the elapsed time, and the left and right ordinate axes represent the ink flow rate and pressure, respectively. Further, the flow rate of the ink that flows into the first tank 12 by the pump 16 is set to, for example, 6 ml/s, while that of the ink that flows into the second tank 14 is set to, for example, 3 ml/s when the ink head 13 is not discharging the ink onto the recording medium.

Since the rate of ink feed into the first tank 12 by the pump 16 continually exceeds the inflow of the ink that flows from the ink head 13 into the second tank 14, the amount of ink remaining in the tank 14 is reduced with the passage of time.

Thereupon, the negative pressure in the second tank 14 is increased, as shown in FIG. 3. Since the negative pressure in the second tank 14 becomes higher, in this case, the inflow of the ink that flows from the ink head 13 into the tank 14 somewhat increases, as shown in FIG. 3. If the negative pressure in the second tank 14 exceeds a preset value for the pressure regulation valve 26 in the pressure regulation mechanism 17, the fourth ink passage 34 is communicated (opened). In other words, if the pressure difference between the upstream (second tank 14 side) and downstream (first tank 12 side) of the pump 16 exceeds the preset value for the pressure regulation valve 26, the valve element 41 moves in the direction of arrow b, resisting the urging force of the spring 42, whereupon the fourth ink passage 34 is communicated (opened).

Since the flow resistance of the fourth ink passage 34 is lower than that of the downstream (first tank 12 side) of the pump 16 in the third ink passage 33, most of the ink fed from the pump 16 flows to the suction side of the pump 16 through the fourth ink passage 34. Thus, if the fourth ink passage 34 is open, as shown in FIG. 4, the ink flows in the direction of the illustrated arrows and circulates in the fourth ink passage 34. If the fourth ink passage 34 is opened in this manner, the inflow of the ink that flows from the pump 16 into the first tank 12 is reduced considerably.

Since the ink then continues to flow from the ink head 13 into the second tank 14, the amount of ink remaining in the tank 14 is gradually recovered (or increased), so that the negative pressure in the tank 14 is reduced. If the negative pressure in the second tank 14 falls below the preset value for the pressure regulation valve 26 in the pressure regulation mechanism 17, the fourth ink passage 34 is closed, whereupon a predetermined amount of ink is caused to flow into the first tank 12 by the pump 16. Thus, the pressure difference between the upstream (second tank 14 side) and downstream (first tank 12 side) of the pump 16 is reduced. As this pressure difference is reduced, the valve element 41 is moved in the direction of arrow a by the urging force of the spring 42, whereupon the fourth ink passage 34 is closed.

In an actual operation, the fourth ink passage 34 is closed and opened in a very short cycle. Therefore, the pressure and ink amount in the second tank 14 can be kept constant. Although the negative pressure in the second tank 14 fluctuates, moreover, this fluctuation is restricted within a range such that it does not influence the ink head 13.

As described above, the negative pressure and ink amount in the second tank 14 can be kept constant by means of the pressure regulation mechanism 17, which includes the fourth ink passage 34 that connects the upstream (second tank 14 side) and downstream (first tank 12 side) of the pump 16 and the pressure regulation valve 26 for opening and closing the passage 34.

Meniscus rupture on the nozzle can be prevented by keeping the pressure and ink amount in the second tank 14 constant so that a negative pressure is maintained in the ink head 13.

In the present embodiment, full-color recording is performed on the recording medium by using inks of a plurality of colors, such as Y, M, C and K. Alternatively, however, the inkjet recording apparatus may be of a monochrome type for recording images of only one color, such as K.

Further, the ink head 13 may suitably be selected from various types, including a thermal inkjet head and piezoelectric inkjet head.

In the present embodiment, the ink head is a line-type head, which extends beyond the width of the recording medium and serves for recording on the medium. Alternatively, however, the present invention may be applied to a serial head configured to perform recording by scanning the recording medium.

In the present embodiment, moreover, the gear pump is used for the pump 16. As long as the aforementioned relationship between the flow rates is satisfied, the pump 16 used may be a piston pump, or a bellows pump etc.

Second Embodiment

The following is a detailed description of a second embodiment of the present invention.

Figure 5:
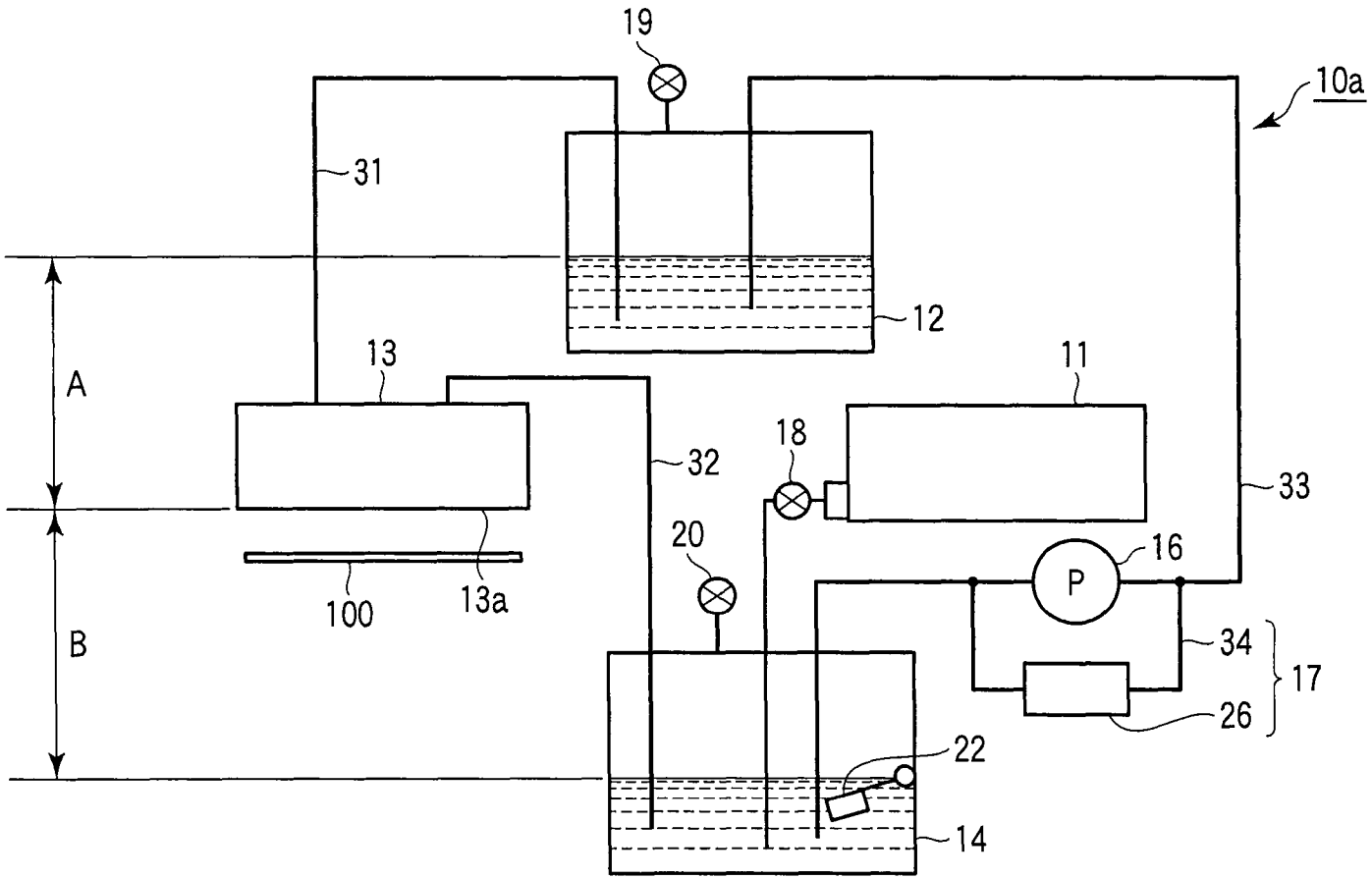
FIG. 5 is a block diagram showing a configuration of an inkjet recording apparatus according to a second embodiment of the invention.

FIG. 5 is a block diagram showing a configuration of an inkjet recording apparatus according to the second embodiment of the invention. Like reference numbers designate like portions of the apparatus configurations of the first and second embodiments, and a description of those portions is simplified.

In an inkjet recording apparatus 10*a* shown in FIG. 5, both first and second tanks 12 and 14 are open to the atmosphere while ink is circulating. At this time, the second tank 14 is placed than the previously described first embodiment downward.

Thus, a negative pressure is produced in the ink head 13 by the hydraulic head difference between the first and second tanks 12 and 14, whereby the meniscus on the nozzle face is maintained.

The ink cartridge 11 communicates with the second tank 14 by means of an ink tube. The ink tube connected between the ink cartridge 11 and the second tank 14 is provided with a supply valve 18. The valve 18, which serves to control the communication between the ink cartridge 11 and second tank 14, is opened when the amount of ink remaining in the tank 14 falls below a predetermined value.

Further, the second tank 14 is provided with the float 22. The float 22 is detection means for detecting the liquid level in order to maintain the predetermined amount of ink in the second tank 14. If the amount of ink in the tank 14 falls below the predetermined value, it is detected by the float 22, and the supply valve 18 is opened. When the valve 18 is opened, the ink is supplied from the ink cartridge 11.

If the ink amount in the second tank 14 reaches the predetermined value, the supply valve 18 is closed, whereupon the ink supply to the tank 14 is stopped. While the ink is circulating, both the first and second tanks 12 and 14 are opened to the atmosphere.

The pressure regulation valve 26 in a pressure regulation mechanism 17 is set so that it allows a fourth ink passage 34 to open when a hydraulic head difference for the case where the first and second tanks 12 and 14 are filled with their respective appropriate amounts is exceeded.

The delivery of the pump 16 is greater than the amount of ink that flows from the ink head 13 into the second tank 14. Without the pressure regulation mechanism 17, therefore, the ink in the second tank 14 is delivered beyond its inflow into the first tank 12, so that the amount of ink in the second tank 14 is reduced, while that in the first tank 12 increases. Thereupon, the balance between a distance A (FIG. 5) between the nozzle face of the ink head 13 and the surface of the ink in the first tank 12 and a distance B (FIG. 5) between the nozzle face of the head 13 and the ink surface in the first tank 12 is broken, so that the meniscus on the head nozzle is broken, and printing is disabled.

However, the pressure regulation mechanism 17 is provided in the second embodiment. If the hydraulic head difference formed by the sum of the respective ink level distances A and B of the first and second tanks 12 and 14 exceeds a preset value for the pressure regulation valve 26, therefore, the ink that flows from the pump 16 into the first tank 12 is delivered to the fourth ink passage 34. Thus, the sum of the ink level distances A and B of the first and second tanks 12 and 14 can be kept constant, so that the meniscus in the ink head 13 can be stabilized.

Third Embodiment

The following is a detailed description of a third embodiment of the present invention.

Figure 6:
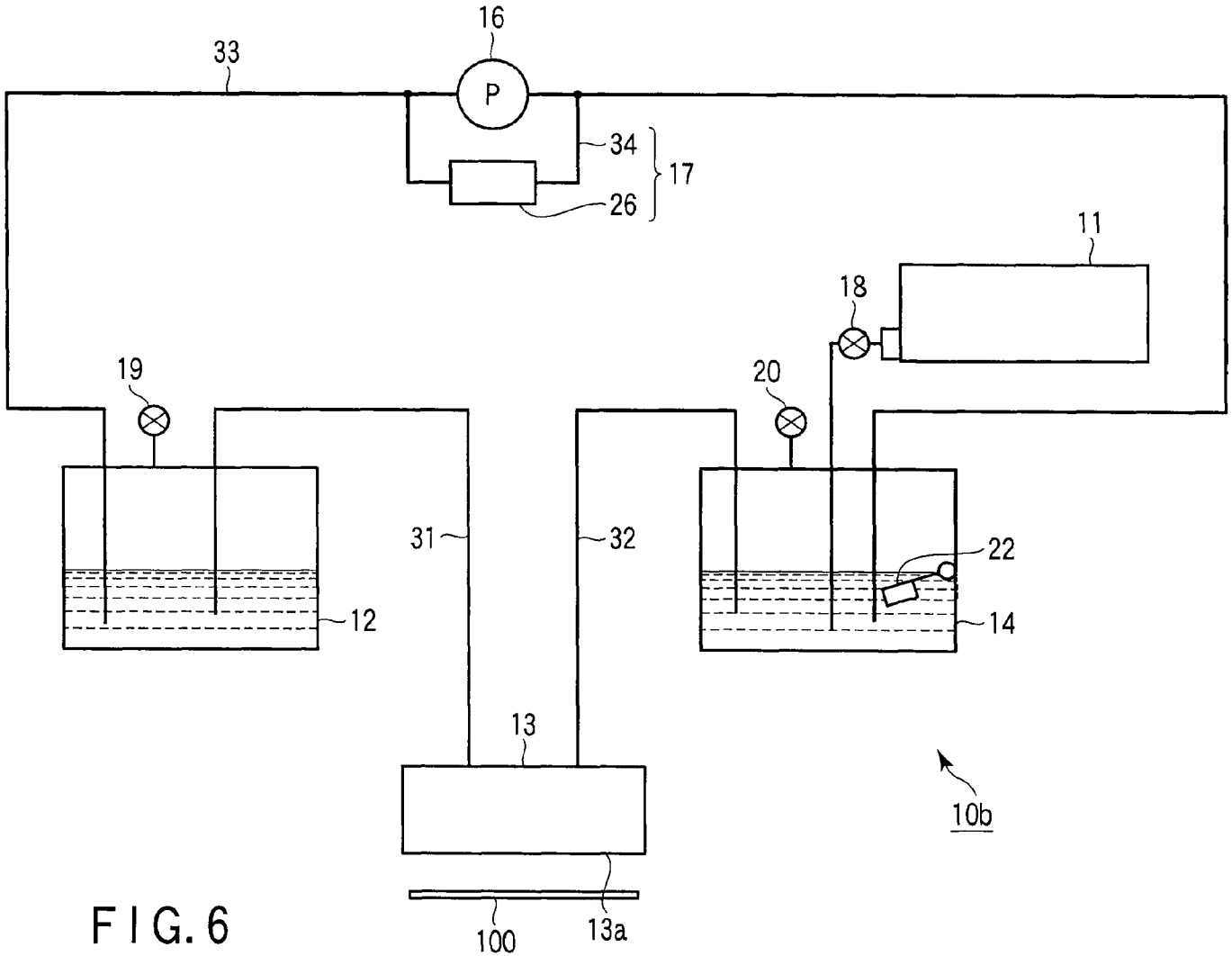
FIG. 6 is a block diagram showing a configuration of an inkjet recording apparatus according to a third embodiment of the invention.

FIG. 6 is a block diagram showing a configuration of an inkjet recording apparatus according to the third embodiment of the invention. Like reference numbers designate like portions of the apparatus configurations of the first to third embodiments, and a description of those portions is simplified.

In an inkjet recording apparatus 10*b* shown in FIG. 6, both first and second tanks 12 and 14 are sealed while ink is circulating. At this time, the internal pressure of the first tank 12 is set to be lower than that of the second tank 14. Further, the respective internal pressures of the tanks are adjusted to appropriate negative pressures such that a meniscus can be maintained in a nozzle of the ink head 13. The respective vertical positions of the first and second tanks 12 and 14 and the nozzle face 13*a* of the ink head 13 are set arbitrarily. In other words, the relationships between the vertical positions of the first and second tanks 12 and 14 and the nozzle face 13*a* of the ink head 13 may be varied provided that the respective internal pressures of the tanks 12 and 14 are appropriate.

The ink cartridge 11 communicates with the second tank 14 by means of an ink tube. The ink tube connected between the cartridge 11 and tank 14 is provided with a supply valve 18. The valve 18, which serves to control the communication between the cartridge 11 and tank 14, is opened when the amount of ink remaining in the tank 14 falls below a predetermined value. Then, the ink in the cartridge 11 is supplied to the tank 14.

The second tank 14 is provided with the float 22. The float 22 is detection means for detecting the liquid level in order to maintain the predetermined amount of ink in the tank 14. If the amount of ink in the tank 14 falls below the predetermined value, it is detected by the float 22, and the supply valve 18 is opened. When the valve 18 is opened, the ink is supplied from the ink cartridge 11. If the ink amount in the second tank 14 reaches the predetermined value, the valve 18 is closed, whereupon the ink supply to the tank 14 is stopped.

While the ink is circulating, the atmospheric valve 19 of the first tank 12 is closed, whereupon the tank 12 is cut off from the atmosphere. The atmospheric valve 20 of the second tank 14 is also closed, whereupon the tank 14 is cut off from the atmosphere.

The respective internal pressures of the first and second tanks 12 and 14 during the ink circulation are adjusted to appropriate negative pressures such that a meniscus can be maintained in a nozzle of the ink head 13. Further, the pressure regulation valve 26 in a pressure regulation mechanism 17 is set so that it allows the fourth ink passage 34 to open when the pressure difference between the first and second tanks 12 and 14 set in the aforementioned manner is exceeded.

The delivery of the pump 16 is greater than the amount of ink that flows from the ink head 13 into the second tank 14. Without the pressure regulation mechanism 17, therefore, the ink in the second tank 14 is delivered beyond its inflow into the first tank 12, so that the amount of ink in the second tank 14 is reduced, while that in the first tank 12 increases. If the ink amount in the second tank 14 is reduced, the ink is supplied from the ink cartridge 11 to keep the ink amount in the tank 14 constant. Thereupon, the pressure in the first tank 12 increases. Consequently, the balance between the pressures in the first and second tanks 12 and 14 is broken, so that the meniscus on the nozzle face 13*a* of the ink head 13 is broken, and printing is disabled.

However, the pressure regulation mechanism 17 is provided in the third embodiment. If the amount of ink and hence the pressure in the first tank 12 increase so that the difference between the pressures in the first and second tanks 12 and 14 exceeds a preset value for the pressure regulation valve 26, the ink that flows from the pump 16 into the first tank 12 is fed into the fourth ink passage 34. Thus, the ink amount and pressure in the first tank 12 can be kept constant with reference to those in the second tank 14, so that the meniscus in the ink head 13 can be stabilized.

In this third embodiment, both the first and second tanks 12 and 14 are sealed. Since the ink passage is cut off from the external air if these tanks are sealed, there is no possibility of dust and water in the external air permeating into the ink passage. Accordingly, a misfire attributable to the ink supply can be suppressed. Since the tanks are sealed, moreover, the ink passage is also independent of atmospheric pressure. As mentioned before, therefore, the positional relationship between the ink head 13 and tanks can be arbitrarily set by appropriately setting the internal pressures of the tanks.

Although some embodiments of the present invention have been described herein, it is to be understood that the invention is not limited to those precise embodiments, and that various changes and modifications may be effected therein without departing from the scope or spirit of the invention.

Further, the embodiments described above include various stages of inventions, and various inventions can be extracted by appropriately combining a plurality of disclosed constituent elements. Even if some of the constituent elements of the embodiments are deleted, for example, the problems described herein can be solved. If the effects described herein can be obtained, a configuration from which some constituent elements are deleted can also be extracted as an invention.

According to the present invention, there may be provided an inkjet recording apparatus in which a low-priced ink circulation passage that does not require complicated control is formed so that a meniscus in an ink head can be stabilized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet recording apparatus comprising:

an ink head having a nozzle face on which a plurality of nozzles for discharging ink are formed, the ink head discharging the ink on a recording medium to form an image;

a first tank configured to store the ink to be supplied to the ink head, and add positive pressure to the ink head;

a first passage that connects the ink head and the first tank to each other;

a second tank configured to store the ink not having been discharged from the ink head, and add negative pressure to the ink head;

a second passage that connects the ink head and the second tank to each other;

a third passage that connects the second tank and the first tank to each other;

a pump disposed on the third passage and configured to feed the ink from the second tank into the first tank;

a bypass passage that is connected in parallel with the pump on the third passage; and a pressure regulation valve which is disposed on the bypass passage, and which is configured to circulate the ink within the bypass passage in accordance with a pressure inside the first tank and a pressure inside the second tank, so as to regulate the pressure inside one of the first tank and the second tank such that a predetermined pressure is applied to the nozzles of the ink head;

wherein, when the pressure regulation valve opens, the bypass passage has a lower flow resistance than a flow resistance downstream of the pump in the third passage, and the ink fed by the pump is branched and fed back to an inlet side upstream of the pump through the bypass passage.

2. The inkjet recording apparatus according to claim 1, wherein the pressure regulation valve regulates the pressure inside the second tank by regulating an amount of ink fed to the first tank and an amount of ink to be fed back through the bypass passage in accordance with a negative pressure in the second tank.

3. An inkjet recording apparatus comprising:

an ink head having a nozzle face on which a plurality of nozzles for discharging ink are formed, the ink head discharging the ink on a recording medium to form an image;

a first tank configured to store the ink to be supplied to the ink head, and add positive pressure to the ink head;

a first passage that connects the ink head and the first tank to each other;

a second tank configured to store the ink not having been discharged from the ink head, and add negative pressure to the ink head;

a second passage that connects the ink head and the second tank to each other;

a third passage that connects the second tank and the first tank to each other;

a pump disposed on the third passage and configured to feed the ink from the second tank into the first tank;

a bypass passage that is connected in parallel with the pump on the third passage; and a pressure regulation valve which is disposed on the bypass passage, and which is configured to circulate the ink within the bypass passage in accordance with a pressure inside the first tank and a pressure inside the second tank, so as to regulate the pressure inside one of the first tank and the second tank such that a predetermined pressure is applied to the nozzles of the ink head;

wherein the pressure regulation valve:

opens when a negative pressure in the second tank exceeds a predetermined value;

branches and feeds back the ink flowing out from the pump into the bypass passage, such that an amount of ink fed to the first tank is reduced to be less than an amount of ink fed into the second tank; and closes, when the negative pressure becomes the predetermined value or less, such that the amount of ink fed to the first tank is increased to be more than the amount of ink fed into the second tank, to regulate the pressure inside the second tank.

* * * * *